United States Patent [19]

Hasegawa et al.

[11] 4,395,365

[45] Jul. 26, 1983

[54] METAL CLEANING COMPOSITION CONTAINING A FATTY ACID SUCCROSE ESTER AND OTHER DETERGENT COMPONENTS

[75] Inventors: Masami Hasegawa, Fuji; Koji Kato, Uozu, both of Japan

[73] Assignee: Nissan Motor Co., Ltd., Yokohama, Japan

[21] Appl. No.: 294,149

[22] Filed: Aug. 19, 1981

[30] Foreign Application Priority Data

Sep. 8, 1980 [JP] Japan ..... 55-124198

[51] Int. Cl.[3] ..... C11D 1/14; C11D 1/66; C11D 1/72

[52] U.S. Cl. ..... 252/545; 252/153; 252/173; 252/174.18; 252/174.19; 252/174.21; 252/546; 252/555

[58] Field of Search ..... 252/89.1, DIG. 1, DIG. 5, 252/DIG. 14, 174.18, 174.19, 174.21, 173, 153, 554, 545, 33.4

[56] References Cited

U.S. PATENT DOCUMENTS

| | | | |
|---|---|---|---|
| 2,893,990 | 7/1959 | Hass et al. | 252/135 |
| 2,970,962 | 2/1961 | Hass et al. | 252/135 |
| 3,018,282 | 1/1962 | Crecelius | 252/DIG. 1 |
| 3,692,684 | 9/1972 | Hentschel | 252/174.19 |
| 3,719,598 | 3/1973 | King | 252/33.4 |
| 3,816,318 | 6/1974 | Hentschel | 252/174.19 |
| 3,872,020 | 3/1975 | Yamagishi | 252/174.19 |
| 4,048,121 | 9/1977 | Chang | 252/527 |
| 4,111,855 | 9/1978 | Barret et al. | 252/545 |

FOREIGN PATENT DOCUMENTS

| | | |
|---|---|---|
| 1817543 | 7/1970 | Fed. Rep. of Germany . |
| 2263927 | 7/1974 | Fed. Rep. of Germany . |
| 48-26923 | 8/1973 | Japan . |
| 51-37102 | 3/1976 | Japan . |
| 53-05710 | 4/1978 | Japan . |
| WO80/00452 | 3/1980 | PCT Int'l Appl. . |
| 662578 | 5/1979 | U.S.S.R. . |

*Primary Examiner*—John E. Kittle
*Assistant Examiner*—Hoa Van Le
*Attorney, Agent, or Firm*—Schwartz, Jeffery, Schwaab, Mack, Blumenthal & Koch

[57] ABSTRACT

An industrial detergent useful for degreasing and cleansing of metal parts, which is in the form of an aqueous solution and comprises 3 to 20 parts by weight of a fatty acid sucrose ester as a nonionic surfactant, 3 to 15 parts by weight of polyoxyethylene alkyl ether also as a nonionic surfactant, 1 to 10 parts by weight of a chelating agent for metal ions typified by EDTA, 1 to 5 parts by weight of a petroleum sulfonic acid salt, preferably an alkanolamine salt, as a rust-inhibiting agent and 3 to 10 parts by weight of propylene glycol. Optionally small amounts of sorbitol and/or CMC may be added. This detergent is weak in alkalinity but strong in deterging power, and the organic surfactants are harmless to the human body and can be decomposed by microorganisms.

14 Claims, No Drawings

METAL CLEANING COMPOSITION CONTAINING A FATTY ACID SUCCROSE ESTER AND OTHER DETERGENT COMPONENTS

BACKGROUND OF THE INVENTION

This invention relates to an industrial detergent in the form of aqueous solution, which contains organic surface-active agents and is useful for cleansing metal parts.

In general, metal parts produced by machining or plastic working such as press-forming must be subjected to a degreasing and cleansing process preparatory to a surface treatment process such as plating, painting or electrochemical rust-inhibiting treatment. A prevailing method for industrial degreasing and cleansing of metal parts is to use an alkaline detergent, though other methods such as cleansing with an acid or an organic solvent and removal of grease and dirt by combustion are also in practice.

Conventional alkaline detergents for this use are usually in the form of aqueous solution containing inorganic surfactants and builders such as caustic alkali, alkali phosphate, lime, alkali carbonate and/or alkali silicate and having pH values above about 9.5. Due to the strong alkalinity, splashing of these detergent solutions is hazardous to the workers and therefore the use of these detergents offers a serious problem to the labor safety and labor environment hygiene. Furthermore, the waste waters treatment is difficult and, even after treatment, can hardly be reused because of high contents of various inorganic salts. Of course, the inorganic ingredients of the alkaline detergents cannot be decomposed by microorganisms in natural water. Particularly, phosphates used as highly effective builders in the alkaline detergents are now regarded as a major source of water pollution because they promote eutrophication of streams, lakes and coastal sea waters and therefore must be eliminated by all means.

Current detergents in a broad sense include synthetic detergents containing organic surface-active agents and having relatively low pH values, but until now such synthetic detergents have been limited to household uses as kitchen cleaners, toilet soaps, shampoos and laundry detergents. The objects of cleaning by the household detergents such as clothing made of fibers and tableware made of ceramic or a stabilized metal such as stainless steel are greatly different from metal parts as machined or press-formed. Also, the dirts and stains to be removed by the household detergents are quite different from grease, machine oil and lubricating oil adhering to the industrially produced metal parts. Accordingly it is no wonder that conventional household detergents do not serve as industrial detergents for metal parts.

The primary requirements of industrial detergents of the class herein concerned with are greatly different from the requirements of household detergents. Considering that the surfaces of metal parts just worked are so active in the electrochemical sense that ionic adsorption constitutes an important factor in the adhesion of dirty matter to the metal surfaces, the detergents must exhibit a sequestering ability. Also considering that the metal surfaces are high in chemical reactivity, the detergents should have a rust- and corrosion-inhibiting ability. Furthermore, the industrial detergents are required to be low in foaming tendency because cleansing of the metal parts is usually performed by a high-temperature high-pressure spraying method in order to complete degreasing and cleansing in a very short period of time.

Until now it has been a common-sense view that the use of strongly alkaline inorganic builders is indispensable to obtain an industrial detergent composition that is sufficiently high in the deterging power, stable at high temperatures and high pressures required to spraying operations, having a chelating effect on metal ions, having rust- and corrsion-inhibiting ability, and weak in foaming tendency.

SUMMARY OF THE INVENTION

It is an object of the present invention to provide an industrial detergent in the form of aqueous solution useful for degreasing and cleansing of metal parts by utilizing organic surface-active agents which are harmless to the human body and can be decomposed by microorganisms.

An industrial detergent according to the invention is in the form of an aqueous solution and comprises the following materials as essential components:

(a) 3 to 20 parts by weight of a fatty acid sucrose ester;

(b) 3 to 15 parts by weight of a polyoxyethylene alkyl ether;

(c) 1 to 10 parts by weight of a chelating agent for metal ions;

(d) 1 to 5 parts by weight of a petroleum sulfonic acid salt; and (e) 3 to 10 parts by weight of propylene glycol.

As an important feature of the present invention, when the above listed ingredients are mixed and dissolved in water so as to give 5000 parts by weight of a dilute detergent solution which is suitable for practical cleansing operation, the pH of the dilute detergent solution is not greater than 8.5.

The fatty acid sucrose ester employed in this detergent is an approved food additive that is harmless to the human body. Even in a solution having a pH value below 8.5, this substance is highly surface-active and exhibits wetting and penetrating abilities. The polyoxyethylene alkyl ether, too, is a surface-active agent which is high in cleansing power but is weak in the foaming tendency and scarcely irritant to the human body. This surface-active agent contributes particularly to the enhancement of the dispersing power and emulsifying power of the detergent. Furthermore, synergistic effects can be gained by joint use of a fatty acid sucrose ester and a polyoxyethylene alkyl ether in a diluted detergent solution having a pH below 8.5.

The chelating agent affords a sequestering ability to the detergent. Preferably this agent is selected from ethylenediaminetetraacetic acid (EDTA), soluble citrates and soluble gluconates.

A petroleum sulfonic acid salt, preferably in alkanolamine salt, is chosen as a rust- and corrosion-inhibiting agent because this material is almost harmless to the human body and does not cause the pH of the diluted detergent solution to exceed 8.5 when used in a quantity in the above specified range.

Propylene glycol is effective for enhancing stableness of the detergent solution, aiding the dispersing, emulsifying and penetrating functions of the surface-active agents and also protecting the skin of the users from chapping.

Preferably a detergent according to the invention may further comprise 0.1 to 2 parts by weight of carboxymethyl cellulose (CMC) as an additive to prevent readhesion of dirty matter to the cleansed metal parts. Also it is preferable to add 1 to 5 parts by weight of sorbitol to this detergent. Sorbitol has generally the same effects as propylene glycol and produces a synergistic effect when used together with propylene glycol.

All the ingredients of a detergent according to the invention are mixed and dissolved in water to give, for example, 100 parts by weight of aqueous solution. In practical cleansing processes, such a concentrated detergent solution will be diluted with water to a relatively low concentration such as 1–5 percent by volume for instance.

A detergent of the invention has enough deterging power for achievement of rapid and complete removal of oil and grease from metal parts as machined or press-formed and can be sprayed at relatively low temperatures compared with conventional detergents of the alkaline inorganic type. This is attributed primarily to the joint use of the aforementioned two kinds of inorganic surface-active agents and the presence of the chelating agent that affords a high sequestering power to this detergent. Furthermore, this detergent is high in its rust- and corrosion-inhibiting ability but is very weak in its foaming tendency. From the viewpoints of labor safety and hygiene, this detergent is harmless and scarcely irritant to the human body and does not emit an offensive smell. As an important advantage of the invention, the ingredients of this detergent can be decomposed by microorganisms and are unlikely to form a potent cause of water pollution.

We are aware that a fatty acid sucrose ester itself has been used in some household detergents and that there are some detergents containing a polyoxyethylene alkyl ether. However, it is believed to be a novel thought to jointly use a fatty acid sucrose ester and a polyoxyethylene alkyl ether to obtain an industrial detergent in the form of an aqueous solution having a pH not greater than 8.5, which is for use in the removal of mineral oil from machined or press-formed metal parts and has the advantages as described above.

DESCRIPTION OF THE PREFERRED EMBODIMENTS

In the present invention, it is preferable to use a fatty acid sucrose ester having 12, 14, 16 or 18 carbon atoms in its fatty acid portion and having a HLB value in the range from 12 to 18. As is well known, HLB stands for Hydrophile-Lipophile Balance proposed by W. C. Griffin in J. Soc. Cosmetic Chemists (1949) and represents the proportion of hydrophilic groups to oleophilic groups in a surfactant molecule. In the case of a fatty acid sucrose ester which is a nonionic surface-active agent, the HLB value is given by the weight ratio of the hydrophilic groups to the oleophilic groups. Fatty acid sucrose esters smaller than 12 in HLB are rather undesirable because of a stronger smell, and such compounds are not commercially available. Fatty acid sucrose esters greater than 18 in HLB are relatively weak in the surface-active property and relatively strong in foaming tendency. Myristic acid sucrose ester and dioleic acid sucrose ester can be named as practically preferable examples.

A polyoxyethylene alkyl ether, too, is a nonionic surface-active agent. In the present invention it is preferable that the alkyl portion of this surfactant is a saturated or unsaturated linear alkyl of 8 to 22 carbon atoms and that HLB of this surfactant falls within the range from 12 to 20. When the carbon atom number of the alkyl portion is less than 8, this surfactant becomes smelly and difficult to commercially obtain. However, the surface-active property of a polyoxyethylene alkyl ether weakens considerably as the carbon atom number of the alkyl exceeds 22. The amount of this surfactant in a detergent of the invention is limited within the range from 3 to 15 parts by weight because in cases of less than 3 parts the effects of this surfactant remain insufficient but in cases of more than 15 parts the detergent becomes relatively strong in its foaming tendency.

Various organic chelating agents for metal ions are useful in the present invention. Examples are salts of aminocarboxylic acids, salts of oxycarboxylic acids, salts of cyclocarboxylic acids, esters of phosphonic acid, succinates, acetates and basic imidosulfonates. Some inorganic compounds such as crystalline sodiumn aluminum silicate and sodium carbonate are also useful, but it is impermissible to use a phosphate typified by sodium triphosphate that will cause eutrophication of streams and lakes. As mentioned hereinbefore, EDTA, citrates and gluconates are particularly preferable primarily because these chelating agents are highly effective and also because they are almost harmless to the human body and they are readily available at relatively low prices. If desired, two or more kinds of chelating compounds may be used jointly.

A petroleum sulfonic acid salt is selected as a rust- and corrosion-inhibiting agent for the reasons as mentioned hereinbefore. It is preferable to use an alkanolamine salt. The amount of this agent in a detergent of the invention is limited within the range from 1 to 5 parts by weight because in cases of less than 1 part the presence of this agent has little effect but in cases of more than 5 parts the detergent becomes higher in pH and lower in its deterging power.

The amount of propylene glycol, whose effects are described hereinbefore, in a detergent of the invention is limited within the range from 3 to 10 parts by weight. When the amount is less than 3 parts the effects remain insufficient, but when the amount is more than 10 parts it becomes difficult to decompose or remove this agent from waste waters resulting from the use of the detergent. It is recommended to use 1 to 5 parts by weight of sorbitol together with propylene glycol. The lower and upper boundaries are set as 1 part and 5 parts, respectively, for the same reasons as explained with respect to propylene glycol.

Also as mentioned hereinbefore, it is preferable to add 0.1 to 2 parts by weight of CMC to a detergent of the invention with a view to preventing re-adhesion of dirty matter to the cleansed metal parts. The addition of more than 2 parts by weight of CMC is undesirable because of causing an unfavorable increase in the viscosity of the resultant detergent.

A detergent according to the invention can easily be prepared by known methods for the preparation of conventional aqueous detergents. In brief, the properly weighed ingredients and water are put into a mixing tank provided with a stirring means in turn, and stirring is continued to achieve thorough mixing and dissolution. In most cases, it is effective to heat the interior of the mixing tank to about 40°–70° C.

EXAMPLE 1

A detergent according to the invention in the form of a concentrated aqueous solution was prepared by thoroughly mixing the following ingredients in a mixing tank equipped with a stirrer.

Myristic acid sucrose ester—12 parts by weight
Polyoxyethylene stearyl ether—10 parts by weight
Sodium citrate—5 parts by weight
Sodium gluconate—5 parts by weight
Triethanolamine salt of petroleum sulfonic acid—4 parts by weight
Propylene glycol—3 parts by weight
CMC—0.5 parts by weight
Water—60.5 parts by weight The specific gravity (15/4° C.) of this detergent was 1.142. This detergent was diluted with water to obtain an 1% (by volume) aqueous solution and a 2% aqueous solution. The pH of the 1% solution was 8.1, and the pH of the 2% solution was 8.3. For the 1% solution, COD (chemical oxygen demand) was 848.7 ppm.

To examine the foaming tendency of the detergent, 50 ml of each of the diluted solutions was poured into a measuring cylinder of a capacity of 100 ml, and the measuring cylinder was vigorously shaken up-and-down twenty times in succession. Thereafter the measuring cylinder was left standing, and the volume of the foam in the cylinder was measured at suitable intervals. The results were as follows.

| | Volume of Foam (ml) | | | |
|---|---|---|---|---|
| | 0 sec | 10 sec | 30 sec | 60 sec |
| 1% solution | 38 | 30 | 12 | 0 |
| 2% solution | 41 | 35 | 14 | 5 |

EXAMPLE 2

The following ingredients were mixed by the same method as in Example 1 to obtain a detergent of the invention in the form of a concentrated aqueous solution.

Dioleic acid sucrose ester—10 parts by weight
Polyoxyethylene lauryl ether—15 parts by weight
EDTA—5 parts by weight
Triethanolamine salt of petroleum sulfonic acid—3 parts by weight
Propylene glycol—5 parts by weight
Sorbitol—5 parts by weight
CMC—1 part by weight
Water—56 parts by weight This detergent solution was a clear and stable solution having a specific gravity (15/4° C.) of 1.160. When diluted with water in the same way as in Example 1, the pH was 8.2 for the 1% solution and 8.4 for the 2% solution. Using these diluted solutions, the foaming tendency of the detergent was examined by the method described in Example 1. The results were as follows.

| | Volume of Foam (ml) | | |
|---|---|---|---|
| | 0 sec | 30 sec | 60 sec |
| 1% solution | 44 | 20 | 8 |
| 2% solution | 43 | 33 | 7 |

REFERENCES 1 AND 2

Two detergent compositions not in accordance with the invention were prepared by mixing the following ingredients, respectively.

| | Reference 1 (parts by weight) | Reference 2 (parts by weight) |
|---|---|---|
| Dioleic acid sucrose ester | 23 | 2 |
| Polyoxyethylene lauryl ether | 20 | 2 |
| EDTA | 3 | 5 |
| Triethanolamine salt of petroleum sulfonic acid | 3 | 3 |
| Propylene glycol | 5 | 5 |
| Sorbitol | 5 | 5 |
| CMC | 1 | 1 |
| Water | 40 | 77 |
| Specific gravity of the solution (15/4° C.) | 1.188 | 1.132 |

The detergent solution of Reference 2 was a clear and stable solution, but the detergent solution of Reference 1 was an unclear, gel-like and rather unstable solution. When diluted with water in the same way as in Example 1, the pH values were as follows.

Reference 1

1% solution—8.4
2% solution—8.6

Reference 2

1% solution—8.1
2% solution—8.3

Using the diluted solutions, the foaming tendencies of the detergents of References 1 and 2 were examined by the above described method. The results were as follows.

| | Volume of Foam (ml) | | |
|---|---|---|---|
| | 0 sec | 30 sec | 60 sec |
| Reference 1 | | | |
| 1% solution | >100 | >100 | 98 |
| 2% solution | >100 | >100 | >100 |
| Reference 2 | | | |
| 1% solution | 30 | 0 | 0 |
| 2% solution | 32 | 4 | 0 |

REFERENCES 3 AND 4

Separately, two detergent compositions not in accordance with the invention were prepared by mixing the following materials, respectively. As can be seen, the detergent of Reference 3 did not contain any polyoxyethylene alkyl ether, whereas the detergent of Reference 4 did not contain any fatty acid sucrose ester.

| | Reference 3 (parts by weight) | Reference 4 (parts by weight) |
|---|---|---|
| Myristic acid sucrose ester | 20 | — |
| Polyoxyethylene oleyl ether | — | 20 |
| EDTA | 5 | 5 |
| Triethanolamine salt of petroleum sulfonic acid | 4 | 4 |
| Propylene glycol | 10 | 10 |
| CMC | 1 | 1 |
| Water | 60 | 60 |
| Specific gravity of the solution (15/4° C.) | 1.133 | 1.154 |

When diluted with water in the same way as in Example 1, the pH values were as follows.

Reference 3

1% solution—8.3
2% solution—8.4

Reference 4

1% solution—8.0
2% solution—8.2

Using the diluted solutions, the foaming tendencies of the detergents of References 3 and 4 were examined by the above described method. The foam volumes after the lapse of 10 sec were as follows.

Reference 3

1% solution—27 ml
2% solution—33 ml

Reference 4

1% solution—23 ml
2% solution—30 ml

EXPERIMENT 1

An experiment was carried out to examine the deterging power of the detergents of Examples 1 and 2 in comparison with the detergents of References 1 to 4.

An experimental grease prepared by mixing 100 parts by weight of red lead ($Pb_3O_4$) with 50 parts by weight of No. 120 grade machine oil was applied onto a major surface of a rectangular piece (30 mm×40 mm wide and 0.5 mm thick) of cold-rolled steel sheet. In advance, each test piece was polished with a fine sandpaper and weighed to the accuracy of 0.1 g. After application of the grease, each test piece was weighed to the aforementioned accuracy and then subjected to cleansing. The deterging power of each detergent was determined by measuring the gross weight of each test piece after cleansing to find out the decrease in weight caused by the deterging operation. Red lead was used to prepare the grease because a very high specific density of this compound was favorable for accurate measurement of the weight decrease of each sample and also because a bright vermilion color of this compound was favorable for visual observation of the grease possibly remaining on the cleansed samples.

Each of the detergents was tested in the form of the above described 1% solution. To each test piece, 20 liters of a detergent solution maintained at 60°±5° C. was sprayed from a conventional spraying machine under a nozzle pressure of about 4.0 kg/cm$^2$ and at a discharge rate of about 4 liters/min. That is, spraying was continued for 5 min. Each test piece was kept fixed at a distance of 20 cm from the spraying nozzle. For comparison, the same cleansing operation was performed also by using only hot water (60°±5° C.). In the test results presented below, the deterging power is given by the decrease in the weight of the grease on each test piece in percentage.

Detergent of Example 1

Deterging power was 91.6%. Vermilion color was scarcely perceptible. Draining of water from the cleansed test piece was good.

Detergent of Example 2

Deterging power was 90.8%. Vermilion color was scarcely perceptible. Draining of water from the cleansed test piece was good.

Detergent of Reference 1

Deterging power was 91.8%. Vermilion color was scarcely perceptible. Draining of water from the cleansed test piece was good. However, this detergent solution was judged to be impracticable because of very significant foaming.

Detergent of Reference 2

Deterging power was 60.8%. Vermilion color remained in the form of thin film over almost the entire surface area, and in some areas the film-like residue was considerably thick.

Detergent of Reference 3

Deterging power was 77.5%. Vermilion color was perceptible in some areas.

Detergent of Reference 4

Deterging power was 84.4%. Vermilion color was vaguely perceptible, giving an impression of the presence of thin film on the cleansed surface.

Hot Water (No Detergent)

Deterging power was 38.3%. Bright vermilion color was perceptible over the entire surface area, so that the appearance was almost unchanged from the initial state.

In this experiment, even hot water containing no detergent exhibited a deterging power of nearly 40%. This can be explained as the effects of the elevated temperature (60° C.) of water and the physical force of the water sprayed at a considerably high pressure.

The detergents of Examples 1 and 2 were similarly excellent in every respect and distinctly superior to the detergent of Reference 3 or 4 prepared by omitting either a fatty acid sucrose ester or a polyoxyethylene alkyl ester.

The detergent of Reference 1 contained excessively large amounts of the fatty acid sucrose ester and the polyoxyethylene alkyl ether. For this reason, a concentrated solution of this detergent became unclear and exhibited an unfavorably high viscosity, and therefore it was not easy to uniformly dilute the concentrated solution to a suitably low concentration solution. Besides, this detergent had a very strong tendency to foaming, so that the practicability of this detergent was doubtful. As to the deterging power, the effect of the increase in the total amount of the organic surface-active agents was almost negligible.

The detergent of Reference 2 contained only very small amounts of the organic surface-active agents. As a consequence, this detergent was very poor in the deterging ability and even inferior to the detergents of References 3 to 4. In a usual sense, this detergent is unsuitable for practial use.

EXAMPLES 3 and 4

Two detergent compositions according to the invention were prepared by mixing the following materials, respectively.

| | Example 3 (parts by weight) | Example 4 (parts by weight) |
|---|---|---|
| Dioleic acid sucrose ester | 3 | 10 |
| Polyoxyethylene lauryl ether | 5 | 15 |
| EDTA | 1.5 | 5 |
| Triethanolamine salt of | 1 | 3 |

-continued

| | Example 3 (parts by weight) | Example 4 (parts by weight) |
|---|---|---|
| petroleum sulfonic acid | | |
| Propylene gylcol | 1.5 | — |
| Propylene glycol monooleate | — | 5 |
| Sorbitol | 1.5 | 5 |
| CMC | — | 1 |
| Water | 86.5 | 56 |

Each of the thus prepared detergent solutions of Examples 3 and 4 was diluted with water to a 1.5% (by volume) aqueous solution, which was used in the experiment described hereinafter.

REFERENCES 5 and 6

Two kinds of conventional detergents of alkaline type containing the following materials were prepared to use in the aforementioned experiment.

| Reference 5 | Reference 6 |
|---|---|
| Caustic alkali | Caustic alkali |
| Polymerized phosphate | Polymerized phosphate |
| Amine salt | Amine salt |
| Anionic surfactant | Higher amine salt of unsaturated fatty acid |
| Nonionic surfactant | Nonionic surfactant |
| Borate | Borate |
| Silicate | Silicate |
| Water | Water |

Each of these alkaline detergent solutions was diluted with water to a 2% solution, which was used in the experiment.

EXPERIMENT 2

In this experiment, steel parts such as shafts and gears for automobiles and aluminum alloy parts such as automotive transmission cases were subjected to degreasing and cleansing with each of the diluted detergent solutions of Examples 3 and 4 and References 5 and 6.

The diluted detergent solutions of Examples 3 and 4 were maintained at a temperature of 50° C. and each sprayed by a multi-nozzle spraying machine. The spraying pressure was 2.4 kg/cm$^2$, and spraying was continued for about 100 sec for each metal part.

The diluted detergent solution of Reference 5 was maintained at a temperature of 70° C., and the diluted detergent solution of Reference 6 at 76° C. These two detergent solutions were each sprayed by another multinozzle spraying machine. The spraying pressure was 3.0 kg/cm$^2$, and the spraying time for each metal part was 120 sec.

The results of the experiment are summarized as follows.

Detergent of Example 3

The degreasing power of the 1.5% solution was judged to be insufficient since some metal parts of intricate shapes were not completely degreased. The rust-inhibiting ability was also insufficient. In several minutes after completion of cleansing, rust appeared on the cleansed steel parts.

Although the 1.5% solution was unsuitable for practical use, it was possible to obtain satisfactory results by somewhat raising the concentration of the detergent solution for spraying.

Detergent of Example 4 the degreasing power of the 1.5% solution was strong enough. All the metal parts were uniformly and completely degreased. The rust-inhibiting ability was also sufficient. After one week no rust was observed on the cleansed metal parts. This detergent solution was evaluated as superior in every respects.

Detergent of Reference 5

The deterging power of the 2.0% solution was strong enough. All the metal parts were uniformly and completely degreased. The rust-inhibiting ability was also sufficient. After one week no rust was observed on the cleansed metal parts.

Detergent of Reference 6

The 2.0% solution of this detergent was comparable to the 2.0% solution of Reference 6 in both the deterging power and the rust-inhibiting ability.

However, the detergent solutions of References 5 and 6 were commonly disadvantageous in the following points.

Firstly, these detergent solutions are strongly alkaline (pH of the 2.0% solution was 9.5–10.5) and therefore undesirable from the viewpoint of labor safety and hygiene. Secondly, the inorganic salts as the principal components of these detergents can hardly be decomposed by microorganisms in natural water, and particularly the phosphate becomes a source of water pollution. Besides, the use of these detergent solutions results in deposition of the inorganic salts in the spraying machine, with a possibility of choking the nozzles. Still further, these detergent solutions must be used at a relatively high liquid temperature such as 70°–80° C. with consumption of a considerable amount of energy, and the concentration of the detergent solution is liable to vary by reason of evaporation of water at such a high temperature. Therefore, there is the need of strictly and continually controlling both the temperature and concentration of the solution. As another reason for the necessity of such a control, the deterging power originating in the active inorganic alkali salts is liable to lower within a relatively short period of time.

In contrast, the detergent solutions of Examples 3 and 4 are only very weakly alkaline (pH of the 1.5% solution was 8.1–8.2) and accordingly offer less problem to the labor safety and hygiene. These detergents do not contain any phosphate, and the organic surfactants as their main components can be decomposed by microorganisms. Therefore, the use of these detergents does not cause water pollution. These detergents exhibit no detrimental effect on the spraying machine and, what is more, gradually cleanse the spraying machine. Since these detergent solutions can be used at a relatively low liquid temperature, the concentration of the detergent solution does not significantly vary. Furthermore, the deterging power originating in the surface-active properties of the organic compounds is stable and does not significantly depend on the concentration of the detergent solution. Therefore, it is unnecessary to strictly control the concentration.

What is claimed is:

1. An industrial detergent useful for degreasing and cleansing of metal parts, the detergent being in the form of an aqueous solution and comprising:

(a) 3 to 20 parts by weight of a fatty acid succrose ester having an HLB value within the range of from about 12 to 18;

(b) 3 to 15 parts by weight of a polyoxyethylene alkyl ether having an HLB value within the range of from about 12 to 20;

(c) 1 to 10 parts by weight of a chelating agent for metal ions;

(d) 1 to 5 parts by weight of a petroleum sulfonic acid salt; and (e) 3 to 10 parts by weight of propylene glycol.

2. A detergent according to claim 1, wherein the composition of the detergent is adjusted such that, when the ingredients (a), (b), (c), (d) and (e) are dissolved in water so as to give 5000 parts by weight of a dilute detergent solution, the pH of said dilute detergent solution is not greater than 8.5.

3. A detergent according to claim 1, wherein said petroleum sulfonic acid salt is an alkanolamine salt of petroleum sulfonic acid.

4. A detergent according to claim 1, wherein the number of carbon atoms of the fatty acid portion of said fatty acid sucrose ester is in the range from 12 to 18.

5. A detergent according to claim 4, wherein said fatty acid sucrose ester is selected from the group consisting of myristic acid sucrose ester and dioleic acid sucrose ester.

6. A detergent according to claim 4, wherein the alkyl portion of said polyoxyethylene alkyl ether is a linear alkyl of 8 to 22 carbon atoms.

7. A detergent according to claim 6, wherein said polyoxyethylene alkyl ether is selected from the group consisting of polyoxyethylene stearyl ether, polyoxyethylene lauryl ether and polyoxyethylene oleyl ether.

8. A detergent according to claim 6, wherein said chelating agent is an organic chelating agent.

9. A detergent according to claim 6, wherein said chelating agent is selected from the group consisting of ethylenediaminetetraacetic acid, soluble citrates and soluble gluconates.

10. A detergent according to claim 9, wherein said petroleum sulfonic acid salt is an alkanolamine salt of petroleum sulfonic acid.

11. A detergent according to claim 9, wherein said petroleum sulfonic acid salt is triethanolamine salt of petroleum sulfonic acid.

12. A detergent according to claim 1 or 11, further comprising 1 to 5 parts by weight of sorbitol.

13. A detergent according to claim 12, further comprising 0.1 to 2 parts by weight of carboxymethyl cellulose.

14. A detergent according to claim 1 or 11, further comprising 0.1 to 2 parts by weight of carboxymethyl cellulose.

* * * * *